United States Patent [19]

Scala

[11] Patent Number: 5,038,754

[45] Date of Patent: Aug. 13, 1991

[54] FIREPLACE HEAT EXCHANGER

[76] Inventor: Neal S. Scala, 1021 Averill Ave., San Pedro, Calif. 90732

[21] Appl. No.: 646,279

[22] Filed: Jan. 28, 1991

[51] Int. Cl.[5] ..... F24B 1/188

[52] U.S. Cl. ..... 126/521; 126/523; 165/170

[58] Field of Search ..... 165/170; 126/521, 523

[56] References Cited

U.S. PATENT DOCUMENTS

| | | | |
|---|---|---|---|
| 241,496 | 5/1881 | Kellhofer et al. | 126/523 X |
| 1,488,195 | 3/1924 | Dawson | 126/523 |
| 4,008,706 | 2/1977 | Buanno | 126/521 |
| 4,149,517 | 4/1979 | Horwinski | 126/521 |
| 4,154,214 | 5/1979 | Owens | 126/521 |

FOREIGN PATENT DOCUMENTS

| | | | |
|---|---|---|---|
| 2274001 | 1/1976 | France | 126/523 |
| 6014 | 3/1906 | United Kingdom | 126/523 |
| 2076518A | 12/1981 | United Kingdom | 126/521 |

*Primary Examiner*—Allen J. Flanigan
*Attorney, Agent, or Firm*—Roger A. Marrs

[57] ABSTRACT

A heat exchanger is disclosed herein for placement in the firebed of a standard fireplace which includes a heat box having an inlet and an outlet separated by a heat chamber having a series of baffles included for conducting an air flow across the panels of the heat box. The panels of the heat box define the heat chamber and are in close or immediate proximity to the fire in the firebed so that the heat induced into the panels is transferred to the air flow conducted past the panels by the baffles. A blower is coupled to the box inlet by a suitable conduit so that ambient room air is provided to the heat chamber while a discharge conducts the heated air flow back into the room.

5 Claims, 1 Drawing Sheet

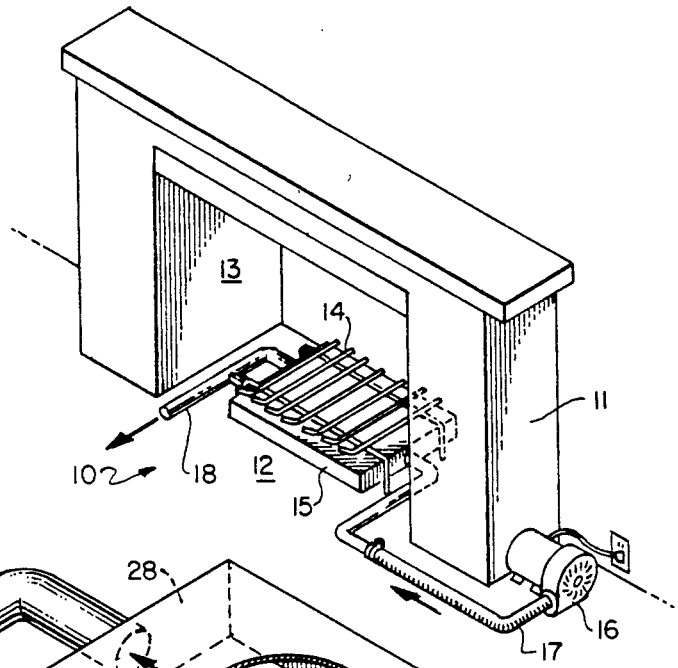
FIG. 1.
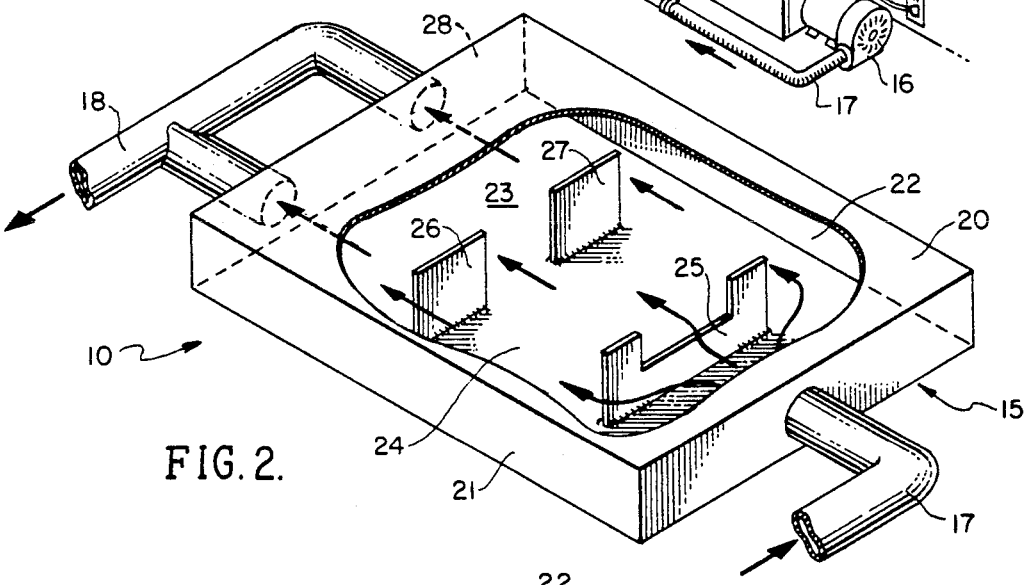
FIG. 2.
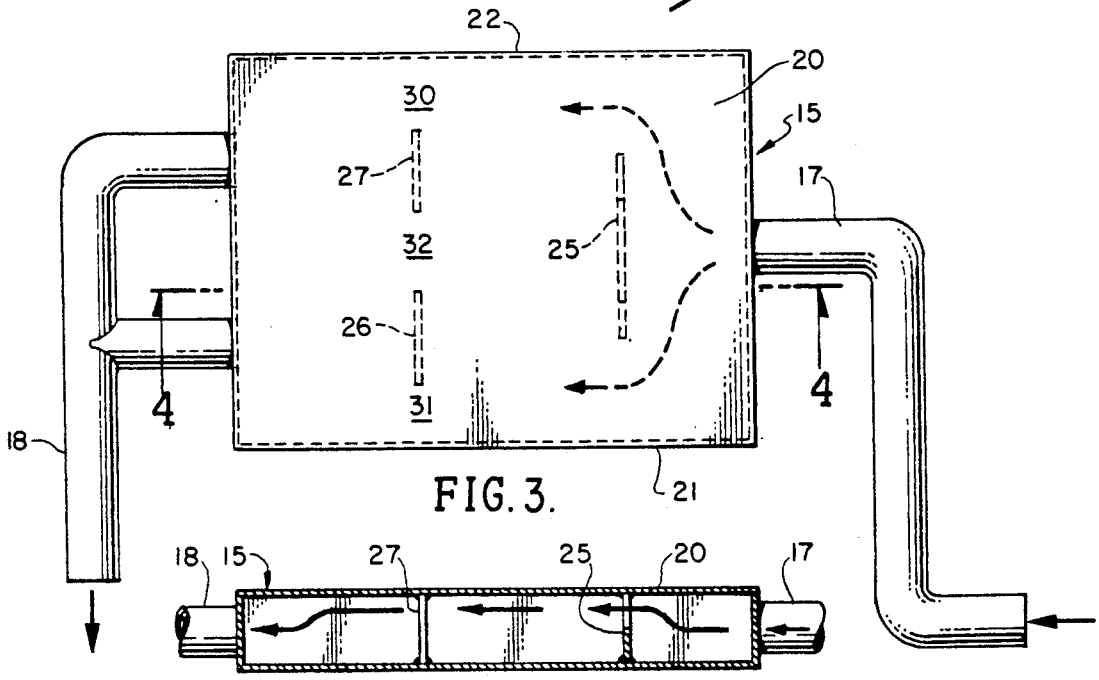
FIG. 3.
FIG. 4.

FIREPLACE HEAT EXCHANGER

BACKGROUND OF THE INVENTION

1. Field of the Invention

The present invention relates to the field of heat exchangers, and more particularly to a novel heat exchanger adapted for use in connection with a conventional fireplace for superheating ambient air in a room and discharging the superheated air back into the room for heating purposes.

2. Brief Description of the Prior Art

In the past, it has been the conventional practice to convert heat in one area to another area by means of an exchanger. In some instances, the heat exchanger is for producing steam or other forms of energy. The basis for such an exchange is to avoid waste of thermal energy and to convert thermal energy into a usable form. In this connection, it is noted that heat is produced in a fireplace by means of fossil fuel, wood fuel, gas fuel or the like, being combusted in the firebed of the fireplace. The heat generated by the combustion is generally conducted through a chimney for dissipation into the outside environment. In some instances, a certain amount of heat is conducted in front of the fireplace into the room for room heat.

Although a fireplace is useful in heating the room, a great portion of the thermal energy or heat is lost through conduction via the chimney. The heat produced and introduced into the room through the frontal area of the fireplace is relatively small and inefficient. Therefore, the thermal loss is great and does not gain efficiency through conventional fireplaces.

Therefore, a long-standing need has existed to provide a means for exchanging the thermal energy or heat within a fireplace into usable heat energy that may be introduced into the room in which the fireplace is constructed. In such an environment, it would be helpful to heat ambient room air so that it can be circulated for room heating purposes.

SUMMARY OF THE INVENTION

Accordingly, the above problems and difficulties are obviated by the use of a paneled container or box which includes a plurality of baffles located in critical conditions so that forced air introduced through an inlet will pass in close proximity to the panels of the box for exit through an outlet. The box is placed in close proximity to a firebed so that the panels are heated and the heat transferred from the panels to the air flow is made efficient via the critically placed baffles.

In one form of the invention, the baffles are critically arranged so that the air flow is directed immediately against the sidewall panels and the top panels of the box since these panels are in close proximity and immediate to the firebed so that maximum heat transference or exchange is experienced. A blower means is connected to an inlet via an inlet conduit so that ambient room air is drawn into the heat box and forced past the panels for discharge back into the room via a discharge or exit conduit.

Therefore, it is among the primary objects of the present invention to provide a novel heat exchange apparatus for use in combination with the firebed of a conventional fireplace so that ambient room temperature may be drawn through the device and superheated for discharge back into the room.

Another object of the present invention is to provide a novel heat exchanger for use in combination with a conventional fireplace whereby air flow is directed through the exchanger by a special arrangement of baffles so that maximum heat exchange is experienced between the firebed of the fireplace and the air flow through the device.

Still another object of the present invention is to provide a novel heat exchanger having a blower means for conducting an air flow past a plurality of baffles so that heat in a firebed is thermally induced into the air flow for discharge and recirculation back into the room.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view of a conventional fireplace incorporating the novel heat exchanging device in the firebed of the fireplace in accordance with the present invention;

FIG. 2 is an enlarged perspective view showing the heat exchanger having its top panel broken away to expose the special arrangement of baffles;

FIG. 3 is a top plan view of the heat exchanger device shown in FIG. 2; and FIG. 4 is a longitudinal cross-sectional view of the heat exchanging device shown in FIG. 3 as taken in the direction of arrows 4—4 thereof.

DESCRIPTION OF THE PREFERRED EMBODIMENT

Referring to FIG. 1, the novel heat exchanger of the present invention is indicated in the general direction of arrow 10, which is used in combination with a conventional fireplace, indicated in general by numeral 11. The fireplace 11 includes a hearth 12 which supports a firebed in a fireplace cavity 13. As is the conventional practice, a frame or fuel support grill 14 is placed within the firebed area and is raised above the surface of the hearth in order to support fuel such as logs, wood or the like. Such fuel is not shown in FIG. 1 but it is to be understood that the frame or grid 14 includes a plurality of parallel spaced-apart rods that are carried on a pair of parallel supports with legs at their opposite ends for raising the rods above the surface of the hearth 12.

The heat exchanger of the present invention is indicated by numeral 15 and takes the form of an elongated box-like construction having sidewall panels and top and bottom panels which enclose a heat chamber. The top panel of the box is in close proximity to the underside of the firebed immediately beneath the rods 14 that support the fuel. In this fashion, heat from the combusted fuel reaches the top panel of the exchanger 15 so that the top panel as well as the side panels become heated.

FIG. 1 further illustrates that a blower means 16 is employed for drawing ambient room air into an inlet conduit 17 for introduction through an inlet into one end of the exchanger 15. The air flow through the exchanger draws heat from the panels of the box-like construction and exhausts the heated airstream through a discharge conduit 18 back into the room for heating purposes.

Referring now in detail to FIG. 2, it can be seen that the box-like structure of the heat exchanger 15 includes a top panel 20 which is surrounded by a continuous sidewall having sidewall panels 21 and 22 arranged in fixed spaced-apart relationship so as to define an inner heat chamber 23. An end wall of the exchanger 15 includes an inlet for receiving the inlet conduit 17 so that air may be conducted from the blower 16 into the heat chamber 23. The exhaust or discharge conduit 18 is connected by a pair of conduits to a pair of outlets at the opposite end of the exchanger from the inlet so that heated air in the heat chamber 23 may be exhausted through the discharge conduit.

FIG. 2 further illustrates the critical location of baffles carried on the bottom panel 24 within the heat chamber 23. The system of baffles includes a first baffle 25 of U-shaped configuration, which is fixedly attached to the bottom panel 24, such as by welding or the like. The first baffle 25 defines lateral passageways about its opposite ends between its opposite ends and the opposing surface of the sidewalls 20 and 21 so that air flow from the inlet may pass therebetween and receive heat from the heated panels 20 and 21. Additionally, input air is passed between the uprights of the baffle along the center line of the exchanger and such air is forced up against the inside surface of the top panel 20, as indicated by the arrows.

FIG. 2 further illustrates the position of baffles 26 and 27 which are welded or otherwise secured to the bottom panel 24 and which are arranged in fixed spaced relationship between baffle 25 and end panel 28 of the exchanger 15. Baffles 26 and 27 are arranged in lateral alignment in spaced relationship not only with respect to each other but with respect to the opposing surfaces of sidewalls 21 and 22 so that air flow will be through the lateral passages adjacent to the sidewalls and between the opposing edges of the baffles 26 and 27. Such construction and critical disposition of the baffles 26 and 27 assures that the air flow through the heat chamber will be against the inside wall surfaces of the heated panels of the exchanger 15.

With respect to FIG. 3, it can be seen that lateral passageways 30 and 31 receive air from around the opposite edges of baffle 25 so that the air from the inlet is directed past the sidewalls for panels 21 and 22. The central passageway 32 is established between the opposing edges of the secondary baffles 26 and 27.

In FIG. 4, it is readily seen that the barrier or baffle 25 forces incoming air from the inlet conduit 17 to rise so as to travel immediately adjacent to the surface of the top panel 20 of the exchanger 15.

In view of the foregoing, it can be seen that the blower 16 will draw ambient air from the room into the inlet conduit 17 for distribution within the heat chamber 23 of the exchanger 15. The pressurized air flow will be distributed within the heat chamber by the baffles 25, 26 and 27 so that the air flow will be immediately adjacent to the surfaces of the sidewall panels 21 and 22 and the underside of the top panel 20. Heat from the firebed within the fireplace superheats the metal of the heat exchanger and the heat from the metal is transferred to the air flow by induction as the air flow passes in contact and close proximity thereto. The superheated air flow is distributed back into the room via the discharge or exhaust outlet 18. It is to be understood that the blower 16 may be operated from a wall socket line source or, in some instances, a battery-operated motor may be employed.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In an apparatus for heating a room having a firebed in a fireplace, the combination which comprises:

a heat exchanger disposed in said firebed and having an internal heat chamber for conducting air flow between an inlet and an outlet, said heat exchanger having a relatively wide top and bottom, and relatively narrow sides extending between the top and bottom to define said heat chamber;

a plurality of baffles secured to said heat exchanger within said heat chamber directing air flow towards the top and sides of said heat exchanger for carrying heat or thermal energy derived from said firebed through said heat chamber;

blower means operably coupled to said heat exchanger inlet and outlet for circulating ambient room air through said heat chamber and exhausting heated air into the room.

2. The invention as defined in claim 1 wherein:

said baffles include a first baffle secured to said exchanger in front of said outlet defining lateral air flow passageways about opposite ends thereof and opposite sidewalls of said heat exchanger;

said first baffle of U-shaped configuration having a central opening above a midsection for directing the air flow upwardly against the top of said heat exchanger.

3. The invention as defined in claim 2 including:

a second and a third baffle secured to said heat exchanger disposed between said first baffle and said outlet arranged in alignment next to each other in parallel with respect to said first baffle;

said second and third baffles separated by a central air passageway and having their ends adjacent the opposite sidewalls of said heat exchanger in spaced relationship to define a pair of lateral air flow passageways conducting air flow about said first baffle through said heat chamber to said outlet.

4. The invention as defined in claim 3 wherein:

said heat exchanger is of box-like construction having side panels, end panels and top and bottom panels defining said heat chamber with said baffles secured between said top and bottom panels.

5. The invention as defined in claim 4 wherein:

said heat exchanger outlet is coupled to a bifurcated conduit for discharging superheated air into the room.

* * * * *